US006464236B2

(12) United States Patent
Chang

(10) Patent No.: US 6,464,236 B2
(45) Date of Patent: Oct. 15, 2002

(54) WHEEL SEAT ASSEMBLY FOR ROLLER SKATE

(76) Inventor: Chung-Cheng Chang, No. 492-16, Chia-Li Hsing, Chia-Li Chen, Tainan Hsien (TW)

( * ) Notice: Subject to any disclaimer, the term of this patent is extended or adjusted under 35 U.S.C. 154(b) by 0 days.

(21) Appl. No.: 09/732,771

(22) Filed: Dec. 11, 2000

(65) Prior Publication Data

US 2002/0070513 A1 Jun. 13, 2002

(51) Int. Cl.[7] ..... A63C 17/20

(52) U.S. Cl. ..... 280/11.223; 280/11.27; 280/11.233; 280/7.13; 36/115; 403/104

(58) Field of Search ..... 280/11.19, 7.13, 280/843, 841, 11.221, 11.226, 11.227, 11.231, 11.223, 11.233, 11.25, 11.26, 11.27, 11.28; 301/5.301, 5.305; 36/115; D21/760, 763, 764

(56) References Cited

U.S. PATENT DOCUMENTS

| | | | | | |
|---|---|---|---|---|---|
| 2,095,942 | A | | 12/1937 | Wetterstrand | |
| 3,152,812 | A | | 10/1964 | Cummings | |
| 3,884,485 | A | * | 5/1975 | Walle | 280/11.1 |
| 3,979,842 | A | * | 9/1976 | Texidor | 36/115 |
| 3,983,643 | A | * | 10/1976 | Schreyer et al. | 36/115 |
| 4,333,249 | A | * | 6/1982 | Schaefer | 36/115 |
| 4,372,566 | A | | 2/1983 | Smith | |
| 4,442,614 | A | | 4/1984 | Farberov | |
| 4,928,982 | A | | 5/1990 | Logan | |
| 5,312,120 | A | | 5/1994 | Wiegner | |
| 5,398,970 | A | * | 3/1995 | Tucky | 280/841 |
| 5,511,824 | A | | 4/1996 | Kim | |
| 5,785,327 | A | | 7/1998 | Gallant | |
| 5,797,609 | A | * | 8/1998 | Fichepain | 280/11.19 |
| 5,803,469 | A | | 9/1998 | Yoham | |
| 5,882,018 | A | | 3/1999 | Petrosino | |
| 5,887,898 | A | | 3/1999 | Petrosino | |
| 6,042,125 | A | | 3/2000 | Wu | |
| 6,065,759 | A | | 5/2000 | Wu | |
| 6,120,039 | A | * | 9/2000 | Clementi | 280/11.19 |
| 6,247,708 | B1 | * | 6/2001 | Hsu | 280/11.223 |
| 6,308,964 | B1 | * | 10/2001 | Chang | 280/11.19 |
| 6,328,318 | B1 | * | 12/2001 | Hsu | 280/11.223 |
| 6,336,644 | B1 | * | 1/2002 | Chu | 280/11.223 |

FOREIGN PATENT DOCUMENTS

| | | |
|---|---|---|
| DE | 19755340 | 6/1999 |
| DE | 19801996 | 7/1999 |
| WO | WO 0016862 | 3/2000 |

* cited by examiner

*Primary Examiner*—Paul N. Dickson
*Assistant Examiner*—Laura B Rosenberg
(74) *Attorney, Agent, or Firm*—Bacon & Thomas

(57) ABSTRACT

A wheel seat assembly of a roller skate includes a sole body fixed on the bottom of a shoe. The sole body is provided with receiving chambers for securing casings therein. The casing defines an axial hole and at least two positioning holes. A roller seat is pivotally mounted in the casing by a pivot member. The pivot member is fitted with a catch member and an elastic member. The catch member may be selectively locked into one of the positioning holes of the casing by an urging action of the elastic member. The roller seat has a roller rotatably mounted therein by a rotation shaft.

4 Claims, 4 Drawing Sheets

WHEEL SEAT ASSEMBLY FOR ROLLER SKATE

BACKGROUND OF THE INVENTION

1. Field of the Invention

The present invention relates to a wheel seat assembly for a roller skate, and more particularly to a wheel seat assembly for a roller skate having a roller seat that can be folded or pulled out.

2. Description of the Related Prior Art

The closest prior art of which the applicant is aware is disclosed in his U.S. patent application Ser. No. 09/325,379, filed on Jun. 4, 1999, entitled "Wheel Assembly for a Roller Skate".

In this application, the pivotal seat 340 is fixed to a bottom plate 412 which is a single plate with a proper hardness and is fixed to a sole 403. Therefore, for satisfying the requirements of shoes of various types and sizes, the manufacturing factory needs to produce bottom plates 412 of different sizes. In addition, when the roller skate is put on to function as one of a pair of walking shoes, the bottom plate 412 is a hard plate and cannot be bent so that the wearer easily feels uncomfortable during walking. Further, the pivotal seat 340 is fixed to the bottom plate by bolts 415, thereby causing inconvenience and difficulty and also consuming a lot of time during the assembling and dismantling process. Further, when the wheel seat 330 is pivoted through a determined angle, the stop 351 of the stop means 350 is rested on the wall of the pivotal seat 340, thereby preventing the wheel seat 330 from proceeding its pivotal action continuously so as to prevent the wheel seat 330 from being folded, thereby preventing causing danger due to a folding action. However, the stop 351 is only pressed by the elastic member 352 without providing the positioning and fixing effects on the stop 351 so that the stop 351 tends to slide to fold the wheel seat 330 during operation of the roller skate, thereby causing danger to the skater.

SUMMARY OF THE INVENTION

The primary objective of the present invention is to provide a wheel seat assembly of a roller skate, wherein the roller seat of the roller skate, according to the practice requirements in use, can be adapted to pull out the rollers to function as a roller skate, or fold the rollers when not in use, and the roller seat can be actually positioned when in use or not in use.

The secondary objective of the present invention is to provide a wheel seat assembly of a roller skate, wherein the roller seat of the roller skate can be conveniently fixed on the casing of the sole body so that the roller skate is easily worked, and the roller skate can be adapted to provide a comfortable sensation to the wearer during travel.

The wheel seat assembly of a roller skate of the present invention includes a sole body fixed on the bottom of a shoe. The sole body is provided with receiving chambers for securing casings therein. The casing defines an axial hole and at least two positioning holes. A roller seat is pivotally mounted in the casing by a pivot member. The pivot member is fitted with a catch member and an elastic member. The catch member may be selectively locked into one of the positioning holes of the casing by an urging action of the elastic member. The roller seat has a roller rotatably mounted therein by a rotation shaft.

Further benefits and advantages of the present invention will become apparent after a careful reading of the detailed description with appropriate reference to the accompanying drawings.

DETAILED DESCRIPTION OF THE PREFERRED EMBODIMENTS

Figure 1:
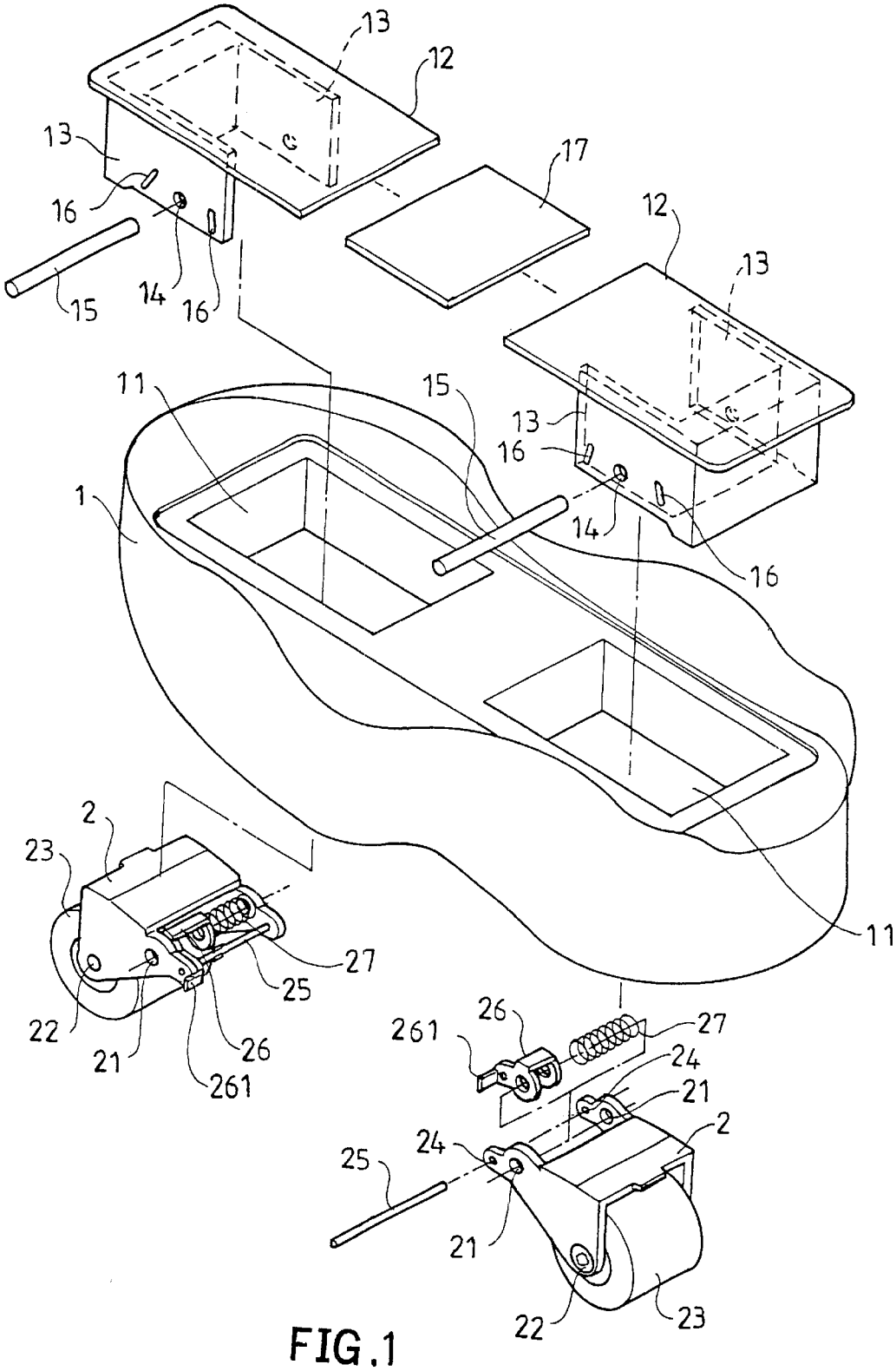
FIG. 1 is a partially exploded perspective view of a wheel seat assembly for a roller skate in accordance with a preferred embodiment of the present invention.

Referring now to FIG. 1, a wheel seat assembly of a roller skate in accordance with the present invention comprises a sole body 1 fixed on the bottom of a shoe and defining at least two receiving chambers 11 each for receiving and securing a casing 12 therein. The casing 12 has two walls 13 each defining a respective axial hole 14 which is used for pivoting a roller seat 2 by a pivot member 15 such as an axle. One of the two walls 13 of the casing 12 defines two positioning holes 16 each allowing insertion and locking of the catch block 261 of the roller seat 2 for positioning the roller seat 2 in place. When a larger span is formed between the two roller seats 2, a pad 17 may be mounted between the two roller seats 2, and the pad 17 can be made of a bendable material. Therefore, when the roller skate is put on, the sole can be bent so as to fit the curvature of the wearer's foot during traveling.

The roller seat 2 is received in the receiving chamber 11 of the sole body 1, and is pivotally mounted to the axial hole 14 of the casing 12 by a pivot member 15 through an axial hole 21. The pivot member 15 is fitted with a catch member 26 and an elastic member 27. The catch member 26 has a protruding catch block 261 whereby the catch block 261 can be selectively locked into one of the two positioning holes 16 of the casing 12 by the urging action of the elastic member 27. Alternatively, the catch block 261 can be detached from the positioning hole 16 of the casing 12 by compression of the elastic member 27 so that the roller seat 2 can be pivoted. The roller seat 2 has a roller 23 rotatably mounted therein by a rotation shaft 22 located at one side of the axial hole 21. The roller seat 2 is provided with a positioning member 25 extending through a positioning hole 24 located at the other side of the axial hole 21. The positioning member 25 is rested by the catch member 26 for limiting position of the catch member 26 not to rotate.

Figure 2:
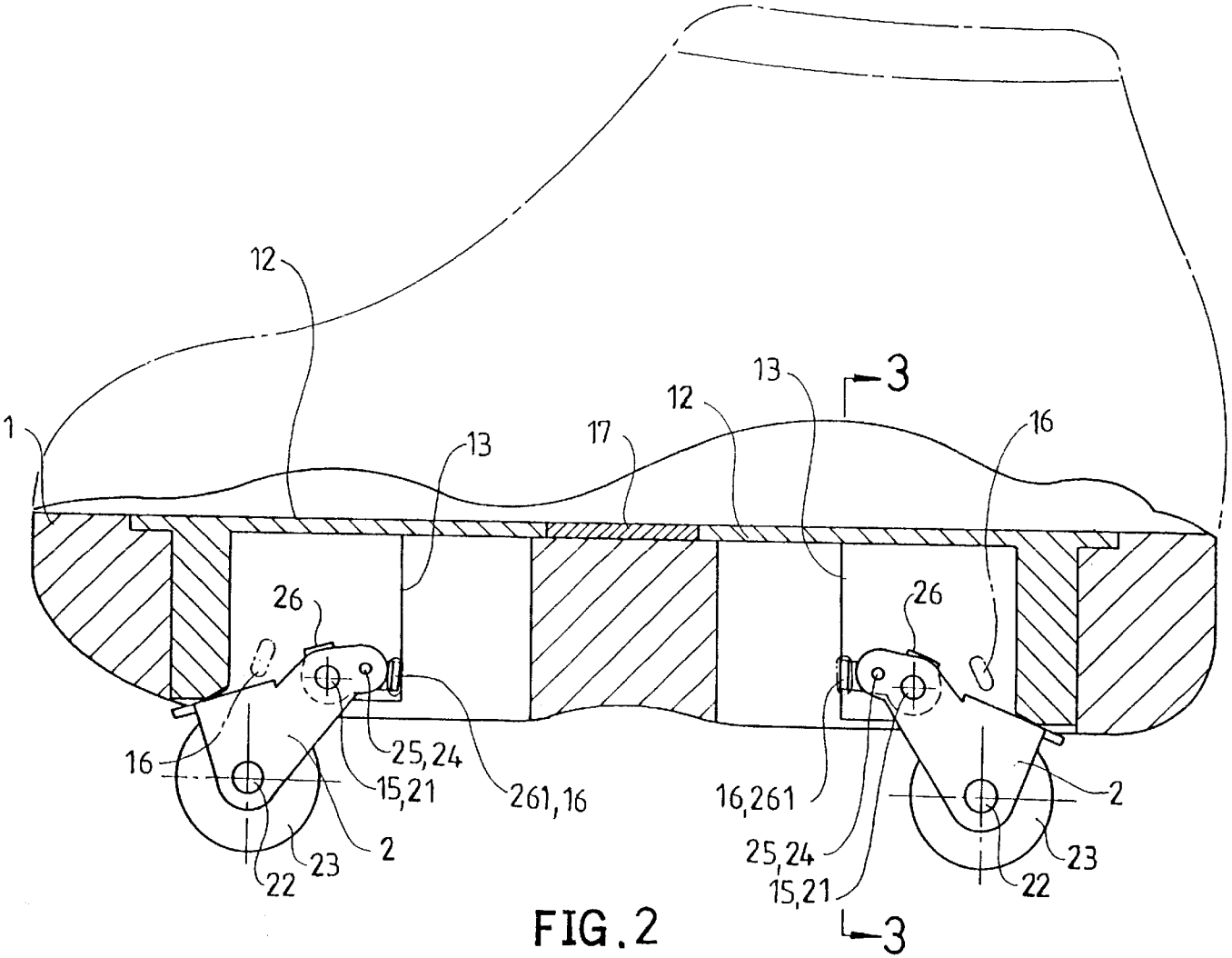
FIG. 2 is a side plan cross-sectional assembly view of the wheel seat assembly for a roller skate as shown in FIG. 1.
Figure 3:
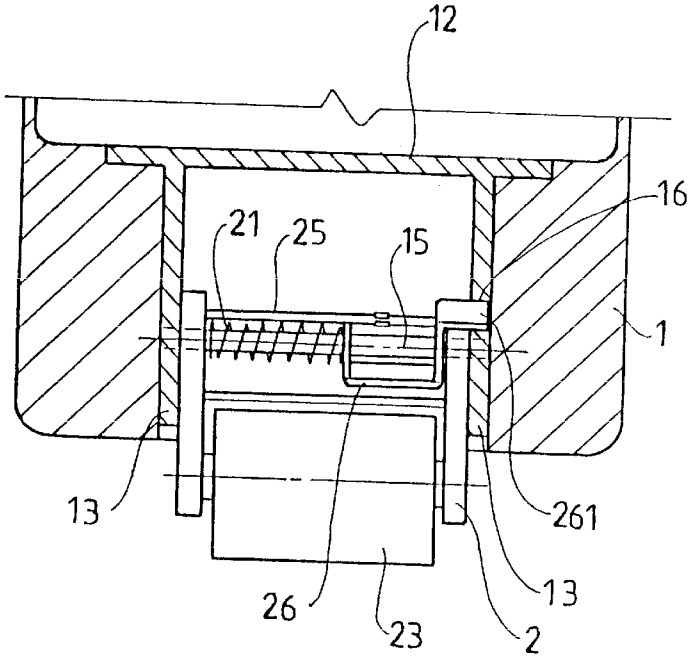
FIG. 3. is a cross-sectional assembly view of the wheel seat assembly for a roller skate along the line 3—3 as shown in FIG. 2.

Referring to FIGS. 2 and 3, the roller seats 2 of the present invention are pivoted to be located at the outer side of the sole body 1, thereby forming the state of a roller skate. Meanwhile, the catch block 261 of each of the two catch members 26 is locked in the respective positioning hole 16. Therefore, the two roller seats 2 cannot be pivoted so as to stably and rigidly support the rollers 23 to rotate on the ground.

Figure 4:
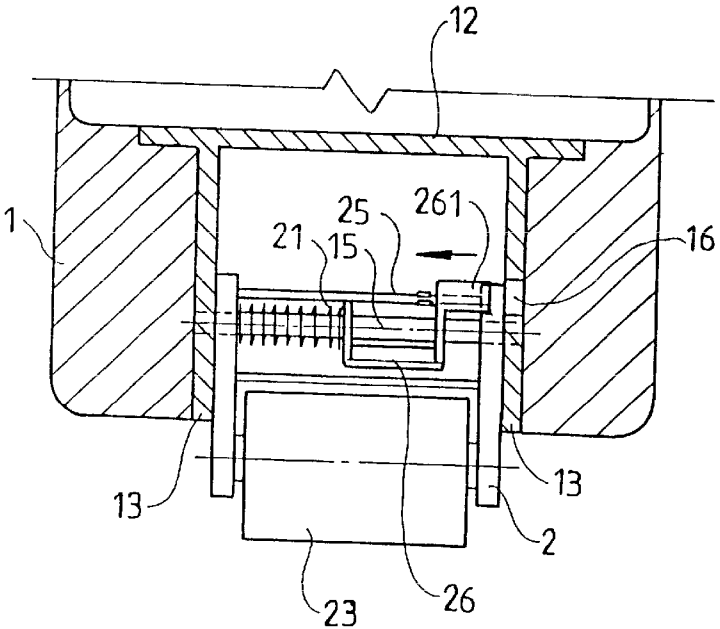
FIG. 4 is an operational view of the wheel seat assembly for a roller skate as shown in FIG. 3 in use.
Figure 5:
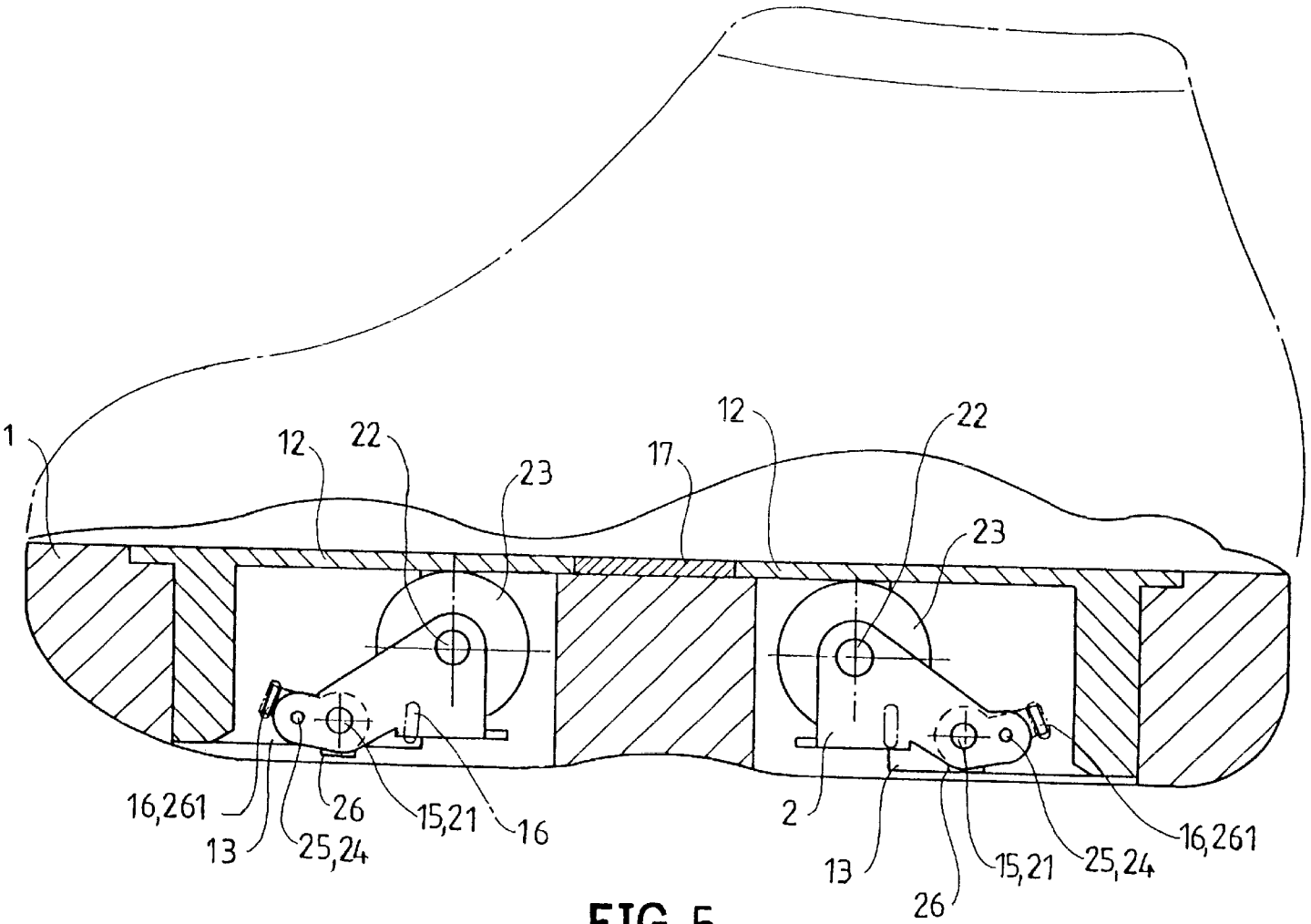
FIG. 5 is an operational view of the wheel seat assembly for a roller skate as shown in FIG. 2 in a folding state.

Referring to FIG. 4, when the roller seat 2 of the roller skate needs to be collapsed, the catch member 26 may be pressed so as to detach the catch block 261 of the catch member 26 from the positioning hole 16. Therefore, the two roller seats 2 can be pivoted about the pivot members 15, so that the two roller seats 2 can be folded into the receiving chambers 11 of the sole body 1 as shown in FIG. 5, while the catch block 261 of the catch member 26 can be locked in the other positioning hole 16 the two roller seats 2 cannot be pivoted freely.

Accordingly, in accordance with the wheel seat assembly of a roller skate of the present invention, the roller seat can be conveniently assembled to the casing of the sole body, thereby facilitating the working fabrication of the wheel seat assembly of the present invention. In addition, after the roller seat is pivoted, the catch block of the catch member may be selectively locked into one of the two positioning holes of the casing of the sole body by the urging action of the elastic member. Therefore, no matter when the roller seat of the roller skate protrudes outward from the sole body to function as a skate, or when the roller seat is hidden in the sole body, the roller seat can be rigidly and stably fixed without the possibility and danger of arbitrarily folding by itself, thereby efficiently assuring the safety of the wheel seat assembly of the present invention.

Further, when the roller seat is hidden in the sole body, the sole body is bent at the location of the pad. Therefore, the bottom of roller skate can be bent so as to conform to variation of curvature of the wearer's foot, thereby providing a comfortable sensation to the wearer.

Although the invention has been explained in relation to its preferred embodiment as mentioned above, it is to be understood that many other possible modifications and variations can be made without departing from the scope of the present invention. It is, therefore, contemplated that the appended claim(s) will cover such modifications and variations that fall within the true scope of the invention.

What is claimed is:

1. A wheel seat assembly of a roller skate comprising:

a casing being secured into a receiving chamber fixed to a sole body, and defining two position holes;

a roller seat pivotally mounted to the casing by a pivotal member; and a catch member being selectively adapted to insert into either positioning hole for locking the roller seat on the casing;

wherein when the catch member is inserted into one of the position holes, the roller seat is in a skating position, and when the catch member is inserted into the other position hole, the roller seat is in a stored position.

2. The wheel seat assembly as claimed in claim 1, further comprises an elastic member being adapted to bias the catch member for positioning.

3. The wheel seat assembly as claimed in claim 1, wherein the catch member is provided with a catch block being adapted to insert into the positioning hole.

4. The wheel seat assembly as claimed in claim 1, wherein the roller seat is provided with a positioning member which limits free rotation of the catch member in a predetermined angle.

* * * * *